US007461515B2

(12) United States Patent
Wellman

(10) Patent No.: US 7,461,515 B2
(45) Date of Patent: Dec. 9, 2008

(54) SEQUENTIAL HOT GAS DEFROST METHOD AND APPARATUS

(76) Inventor: Keith E. Wellman, 11501 SE. 164th Ave., Norman, OK (US) 73026

( * ) Notice: Subject to any disclaimer, the term of this patent is extended or adjusted under 35 U.S.C. 154(b) by 556 days.

(21) Appl. No.: 11/287,923

(22) Filed: Nov. 28, 2005

(65) Prior Publication Data

US 2007/0119196 A1 May 31, 2007

(51) Int. Cl.
*F25D 21/06* (2006.01)
*F25B 47/00* (2006.01)
*F16K 15/00* (2006.01)

(52) U.S. Cl. ..... 62/151; 62/81; 62/200; 62/278; 137/315.33; 137/511; 251/336

(58) Field of Classification Search ..... 62/81, 62/151, 199, 200, 272, 277, 278; 137/315.33, 137/511, 528; 251/336
See application file for complete search history.

(56) References Cited

U.S. PATENT DOCUMENTS 2,272,302 A 2/1942 Krackoweizer
2,492,970 A 1/1950 Curry
3,174,297 A 3/1965 Kuhn et al.
3,633,378 A 1/1972 Toth
4,122,686 A * 10/1978 Lindahl et al. ..... 62/81
4,151,722 A 5/1979 Willitts et al.
4,979,371 A * 12/1990 Larson ..... 62/81
4,993,233 A 2/1991 Borton et al.
5,924,297 A 7/1999 Wolff et al.
6,629,422 B2 10/2003 Wellman
6,742,539 B2 * 6/2004 Lyons ..... 137/219

* cited by examiner

*Primary Examiner*—Marc E Norman
(74) *Attorney, Agent, or Firm*—James T. Robinson

(57) ABSTRACT

The present invention provides a method and apparatus for using hot gas to defrost sequentially each refrigerated display case (evaporator) in a group of refrigerated display cases (evaporators). A unique cross-feed line connects the distributor and the evaporator suction line for each evaporator in the group of evaporators. Like a typical hot gas defrost system, the sequential hot gas defrost system may be time-initiated and time-terminated or time-initiated and temperature-terminated. Each evaporator in the group of evaporators is defrosted in turn while the remaining evaporators in the group continue to operate in the refrigeration mode. A unitary combination check valve and orifice simplifies the sequential hot gas defrost refrigeration system.

5 Claims, 8 Drawing Sheets

1. Within each evaporator in the group of evaporators, provide a cross-feed line between the evaporator discharge line and the distributor, wherein each cross-feed line contains an isolation check valve adjacent the evaporator discharge line, an orifice adjacent the distributor, a liquid injection check valve between the isolation check valve and the liquid injection check valve, and a common cross-feed line connecting each cross-feed line at a location between the isolation check valve and the liquid injection check valve; wherein each isolation check valve prohibits fluid flow from the evaporator discharge line to the common cross-feed line unless the pressure in the evaporator discharge line exceeds the pressure in the common cross-feed line; wherein each liquid injection check valve prohibits fluid flow from the common cross-feed line to the distributor unless the pressure in the common cross-feed line exceeds the pressure in the distributor; and wherein, when the pressure in the common cross-feed line exceeds the pressure in the distributor and the liquid injection check valve permits fluid flow from the common cross-feed line to the distributor, each orifice meters the flow of high pressure liquid refrigerant from the common cross-feed line to the distributor based on the sizing of the orifice.

2. With the group of evaporators in the refrigeration mode with compressors running, shut off the high pressure liquid supply to the metering device of an evaporator selected from the group of evaporators for sequential hot gas defrost.

3. Shut off the valve in the evaporator discharge line from the selected evaporator.

4. Supply high pressure gas refrigerant to the distributor associated with the selected evaporator.

5. Monitor the temperature at the evaporator suction of the selected evaporator.

6. When the temperature at the evaporator suction of the selected evaporator rises to a predetermined set-point temperature, return the now-defrosted selected evaporator to service in the refrigeration mode as follows:

6A. Shut off the high pressure gas refrigerant supply to the distributor associated with the now-defrosted selected evaporator.

6B. Open the valve in the evaporator suction line from the now-defrosted selected evaporator.

6C. Open the high pressure liquid supply valve to the metering device associated with the now-defrosted selected evaporator.

7. Repeat steps 1 through 6 for each additional evaporator in the group of evaporators until each evaporator in the group has been defrosted.

*Fig. 16*

SEQUENTIAL HOT GAS DEFROST METHOD AND APPARATUS

BACKGROUND OF INVENTION

1. Field of the Invention

Applicant's invention relates generally to the field of refrigeration, and more particularly but not by way of limitation, to a method and apparatus for sequentially defrosting a series of evaporators using hot refrigeration gas (also referred to herein as high pressure gas).

2. Discussion

Refrigerated display cases are common to grocery stores, convenience stores, and other purveyors of refrigerated or frozen foods. The display cases are frequently located in the same general location within the store. For ease of installation and convenience to shoppers, the display cases are commonly arranged to form a contiguous line or in series of cases. Adjacent display cases often share similar refrigeration demands. Within each case, a fan circulates cold air in a duct that encircles the case. The duct encloses an evaporator of a refrigeration system.

Grocery stores display frozen foods in open horizontal cases, closed horizontal cases wherein the frozen food products are accessible through glass doors, and closed vertical cases wherein the frozen food products are accessible through glass doors.

Grocery stores may display milk and related products in walk-in refrigerators. The food products are accessible through glass doors, and the shelves are re-stocked from within the walk-in refrigerator. Cheese, cold cuts, butter, juices, refrigerated desserts, and similar items may be available from tiered open-front cases.

In most instances, each case, whether used for refrigerated foods or frozen foods, contains a single evaporator. When appropriate, however, a cold case may contain two, three, or even more evaporators. Here, as in the refrigeration industry, the term "evaporator" may be used interchangeably with the term "evaporator coil" or "cooling coil," from time to time, to mean the evaporator of a refrigeration system where environmental cooling occurs. The term "cold case," as used herein, includes all types, styles, and configurations of refrigerated food cases.

Whether the cold case is an open horizontal frozen food display case or a walk-in dairy case, and whether the cold case has one or more cooling coils, every cold case faces a common problem. Over time, the circulating cold air entrains water vapor from the ambient air. The entrained water vapor condenses and freezes on the cold evaporator coil, thereby decreasing heat transfer efficiency between the refrigerant in the evaporator coil and the air in the duct. Each evaporator must be defrosted periodically to remove the frozen condensate. Thus, each refrigerated case has a refrigeration cycle of operation (also referred to herein as a refrigeration mode) and a defrost cycle of operation (also referred to sometimes herein as a defrost mode). During the refrigeration cycle, the refrigeration system cools the case. During the defrost cycle, a heat source melts frozen condensation which has collected on the evaporator coil.

A metering device introduces high pressure liquid refrigerant into a distributor which, in turn, distributes the refrigerant to the evaporator coils to cool the circulating air. The refrigerant within the evaporator absorbs heat from the circulating cold air used to cool the refrigerated display case. As the refrigerant absorbs heat, the refrigerant changes from a low pressure liquid to a low pressure vapor and then, on further absorption of heat, the temperature of the low pressure vapor increases. The terms "low pressure vapor" and "low pressure gas" are used interchangeably to describe the gaseous refrigerant as it leaves the evaporator after absorbing heat from the air duct. Low pressure vapor streams from two or more evaporator suction lines are combined in a low pressure vapor header (also referred to, interchangeably, as a "low pressure vapor suction header" or "suction header") from which the refrigerant compressor takes suction.

The compressor compresses the low pressure vapor to a high pressure vapor, also referred to herein interchangeably as "high pressure vapor," "high pressure gas" (HPG) or "hot gas". A heat exchanger, normally referred to as a condenser because of its function, then cools the high pressure vapor sufficiently to change the high pressure vapor (HPV) refrigerant to a high pressure liquid (HPL). The high pressure liquid refrigerant is collected in a liquid receiver. From the liquid receiver, the high pressure liquid refrigerant is piped through a high pressure liquid refrigerant header to distributors. A metering device controls introduction of the high pressure liquid refrigerant into the distributor. Automatic expansion valves (commonly referred to as AEV or AXV valves), thermal expansion valves (commonly referred to as TEV or TXV valves), capillary tubing, and simple orifices are all known in the art as devices capable of metering the high pressure liquid refrigerant into the evaporator distributor. In some cases, high pressure liquid refrigerant is metered based on the temperature of the low pressure vapor leaving the evaporator. A single evaporator normally includes several branches which receive refrigerant from a common distributor.

A typical supermarket may have as many as 100 cold cases containing one or more evaporators within each case. The cold cases are typically arranged in groups. Long horizontal cases with open tops may be arranged end to end to permit access from both sides. Walk-in cases are often arranged side-by-side for shopping convenience. Whether electric heating or hot gas heating is used to defrost the cold cases, operators avoid defrosting all cases simultaneously. Instead, the cold cases are grouped based on the build-up of frost within the cases. Those cases which accumulate frost rapidly may be defrosted as many as four times in a 24-hour period. Other cases may require defrosting only three times per day, twice a day, or once a day. Some cases hold frozen foods, while other cases (e.g., dairy cases) require only moderate refrigeration. Still other cases (e.g., a cold case used to hold fresh flowers) my require only minimal refrigeration. The grouping of cases for defrosting may combine cases of differing refrigeration requirements. As used herein, the term "group" is used to mean at least two evaporators which share a common compressor suction header (also called the "evaporator suction line" herein) and a common high pressure liquid header from the condenser.

It is currently common practice to defrost the evaporator coils in a series of cases at the same time, in part because contiguous refrigerated display cases often share a common defrost timer. It is also common to defrost the evaporator coils every 6-8 hours. There are several notable problems with this approach to defrosting the evaporator coils of several cases at the same time.

One problem is that defroster units of the existing art generate a lot of water vapor during a defrost cycle. If a line of contiguous cases is defrosted at the same time, an undesirable layer of frost may accumulate within the case.

Another problem caused by defrosting the cases at the same time is the need for greater electrical power at the same time. Because the defroster unit wiring is often on the same circuit for a given series of cases, this in turn causes a need for larger wiring sizes to carry the high current demand required for the defrost cycle. Additionally, because the cost of power from public utilities is often based on peak demands, the cost of power may be greatly increased by defrosting all the cases at the same time.

Yet another problem with defrost control systems of the existing art is that many are highly complex with digital components and programmable controllers. This makes repairs difficult for repairmen of ordinary skill in the refrigeration art, who are often only familiar with non-digital electrical components. The term "non-digital" refers to relays, contactors, sensors, coils, switches and any other component that generally does not process digital information.

One of the most expensive aspects of the existing practice of defrosting a series of contiguous cases at the same time is that it often leads to food spoilage. By shutting down the refrigeration cycles of contiguous cases at the same time, there can be an increase in the temperature of the food product in the cases. Also, there is often a greater increase in the display section temperature of each case due to the combined effect of defrosting several contiguous cases at the same time.

The applicant recognized a need for an improved method and apparatus for defrosting refrigerated display cases to avoid the problems created when refrigerated display cases are simultaneously defrosted and also to avoid the problems of having complex digital components. Thus applicant obtained U.S. Pat. No. 6,629,422 for a Sequential Defrosting of Refrigerated Display Cases using electric heaters. In the '422 patent, applicant disclosed and claimed a time-initiated, time-terminated defrost control method using electric heat defrosting. Electric heaters apply heat to the outside portions of the evaporator coils and to the heat transfer fins normally attached to the outside portions of the evaporator coils.

An alternative source of heat for defrosting refrigerated display cases is the compressed vapor ("hot gas") from the compressor. Hot gas defrost utilizes the hot gas to apply heat directly to the inside of the evaporator. Most hot gas defrost systems use the latent heat of condensation of the compressed vapor as the heat source, but some use only sensible heat of highly super heated vapor. Most hot gas defrost systems introduce the hot gas at the distributor and bypass the metering device. A defrost time control will operate the compressor during the defrost cycle and shut off the circulating air duct fans. At the same time, the control will energize the hot gas solenoid valve and allow the hot gas to enter the evaporator coil via the distributor and warm the evaporator, thus removing the buildup of frost. The availability of a portion of the energy used for hot gas defrost within the refrigeration system makes hot gas defrost attractive from an energy-saving standpoint.

Hot gas defrost is also attractive from an energy-saving standpoint because the hot gas warms the evaporator coil from within. The warm air blown across the outsides of evaporator coils by electric defrost heaters also heats up the cold case.

Traditional hot gas defrost, while attractive, has many of the drawbacks of traditional electric heater defrost. Defrosting several cold cases at the same time requires more hot gas—hot gas supplied by a compressor powered by electricity. As the compressor continues to run, the cost of power may be greatly increased by defrosting all the cases at the same time. The hot gas must be produced by same compressors used to provide refrigeration to other evaporators. To ensure sufficient head pressure for proper operation of the refrigeration system as a whole, additional controls are sometimes required.

The existing practice of defrosting a series of cold cases at the same time often leads to food spoilage and the expenses associated therewith. Shutting down the refrigeration cycles of contiguous cases at the same time can result in an increase in the temperature of the food product in the cases. Moreover, the combined effect of defrosting several contiguous cases at the same time often results in a greater increase in the display section temperature of each case.

Method and apparatus for sequentially defrosting a group of evaporators using hot gas would reduce or eliminate momentary high demands on the refrigeration system (whether for simultaneous hot gas defrost or for simultaneous cooling of multiple cases), thereby producing a more nearly constant load on the refrigeration system, reducing spoilage related to excessive defrosting, save energy, and permit use of smaller refrigeration systems while ensuring sufficient cooling capacity.

SUMMARY OF THE INVENTION

The present invention provides a method and apparatus for using hot gas to defrost sequentially each refrigerated display case (evaporator) in a group of refrigerated display cases (evaporators). A unique cross-feed line connects the distributor and the evaporator suction line for each evaporator in the group of evaporators. Like a typical hot gas defrost system, the sequential hot gas defrost system may be time-initiated and time-terminated or time-initiated and temperature-terminated. Each evaporator in the group of evaporators is defrosted in turn while the remaining evaporators in the group continue to operate in the refrigeration mode.

The advantages and features of the present invention will be apparent from the following description when read in conjunction with the accompanying drawings and appended claims.

BRIEF DESCRIPTION OF THE DRAWINGS

FIG. 16 illustrates applicant's method of sequentially defrosting each evaporator in a group of evaporators using hot refrigeration gas.

DETAILED DESCRIPTION

In the following description of the invention, like numerals and characters designate like elements throughout the figures of the drawings.

Figure 1:
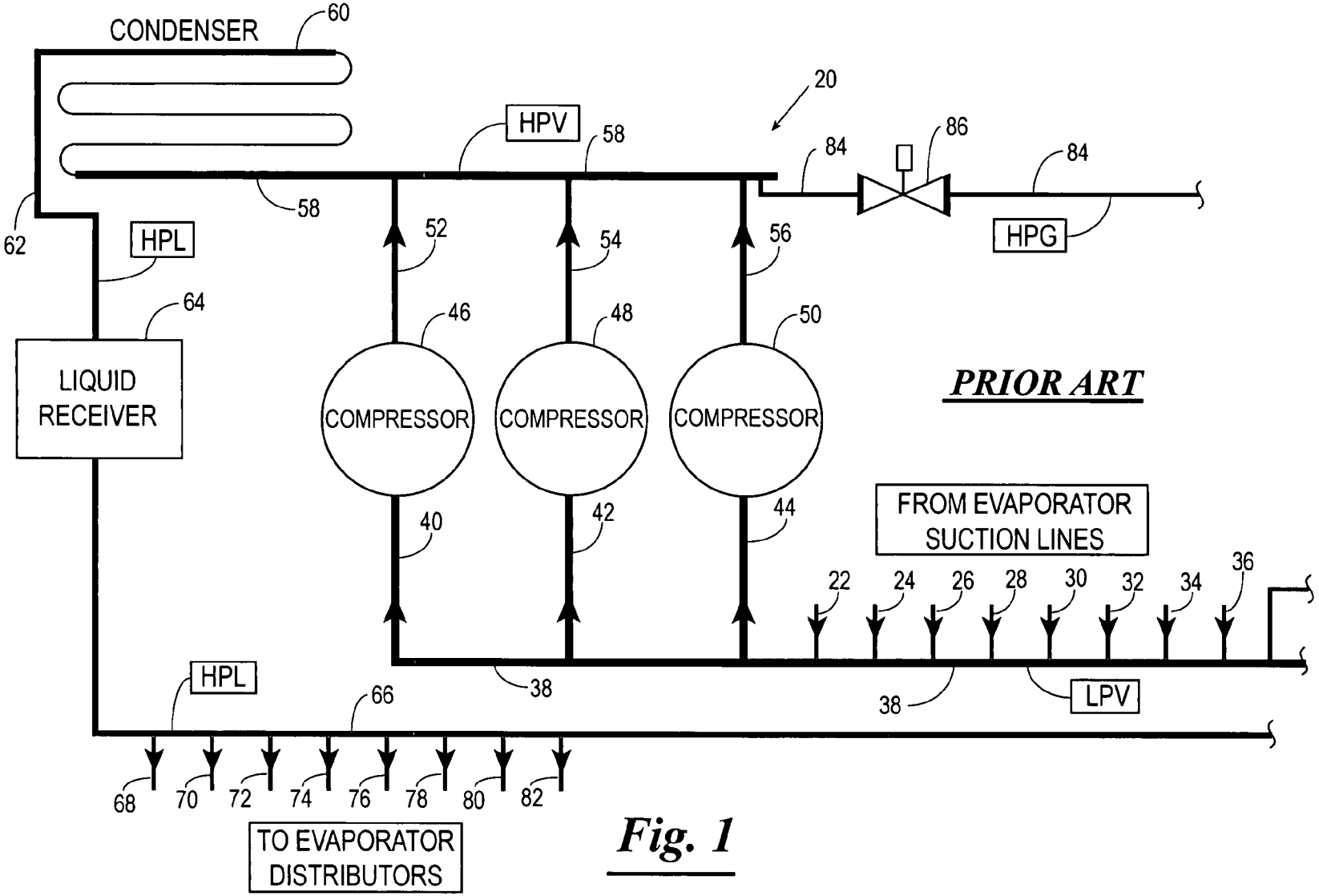
FIG. 1 is a view of a portion of a display case refrigeration system according to the prior art.

Referring to FIG. 1, a typical refrigeration system 20 receives low pressure vapor from a series of evaporators (not shown; see FIG. 2) and returns cool refrigerant to the evaporators. Low pressure vapor (also called low pressure gas, LPV, or LPG) from evaporator discharge lines (also called evaporator suction lines) 22, 24, 26, 28, 30, 32, 34, 36 is combined in a low pressure vapor header 38 (also referred to herein as the evaporator suction header, the same as the compressor suction header). The low pressure vapor is pulled through compressor suction lines 40, 42, and 44 to compressors 46, 48, and 50, respectively. The compressors 46, 48, 50 compress the low pressure vapor to a high pressure vapor (HPV) and discharge the high pressure vapor through compressor discharge lines 52, 54, and 56 (also referred to as high pressure vapor refrigerant lines), respectively, to a high pressure vapor header 58 (also referred to as a high pressure gas header). A condenser 60 then cools the high pressure vapor to a high pressure liquid (HPL), which is carried through a condenser discharge line 62 (also referred to as a high pressure liquid line) and collected in a high pressure liquid receiver 64. From the high pressure liquid receiver 64, the high pressure liquid is carried through a high pressure liquid refrigerant supply header 66 through evaporator HPL refrigerant lines 68, 70, 72, 74, 76, 78, 80, and 82 to distributors of individual evaporators (not shown). Within each evaporator, a metering device 122, 124,126 (see FIG. 2) meters high pressure liquid refrigerant into the evaporator distributor based on a temperature measured at the evaporator outlet (also referred to as the evaporator suction line).

Still referring to FIG. 1, for systems utilizing traditional hot gas defrost, a hot gas main supply line 84 downstream of the compressor(s) supplies high pressure vapor to the distributors. A hot gas main supply line isolation valve 86 is opened during the defrost cycle and closed during the refrigeration cycle.

Figure 2:
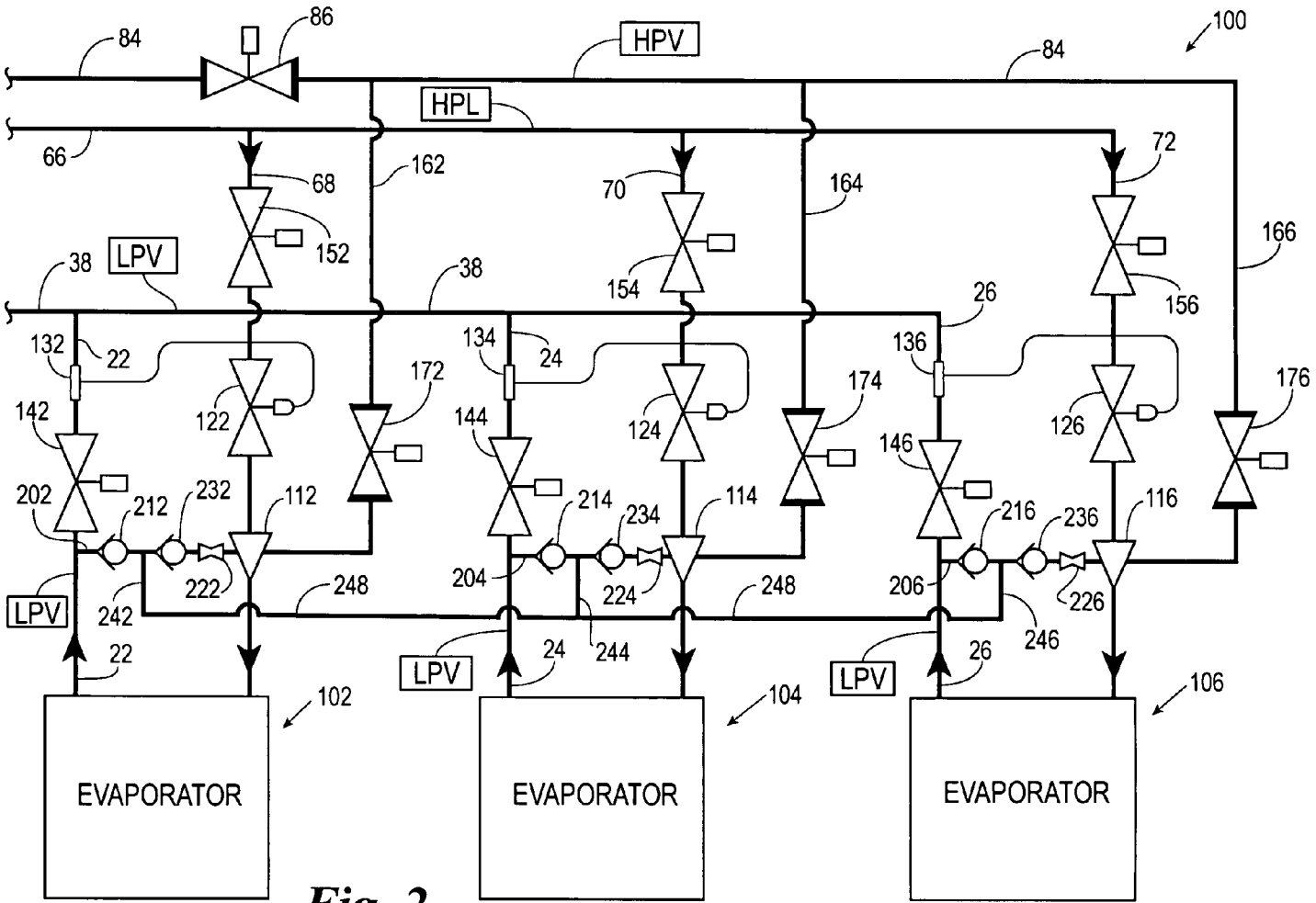
FIG. 2 is a schematic representation of a portion of a display case refrigeration system according to the present invention wherein the display case has three evaporators.

Referring now to FIG. 2, applicant's refrigeration system with sequential hot gas defrost 100 shows evaporators 102, 104, and 106. During the refrigeration cycle of operation, the evaporators 102, 104, 106 receive high pressure liquid refrigerant (HPL) from the HPL header 66 through evaporator HPL supply lines 68, 70, and 72, respectively, and return low pressure vapor (LPV) to the low pressure vapor header 38 through evaporator suction lines 22, 24, and 26, respectively.

Still referring to FIG. 2, wherein the refrigeration system with hot gas defrost 100 is operating in the refrigeration cycle, introduction of high pressure liquid refrigerant into the evaporators 102, 104, 106 through distributors 112, 114, 116 is controlled by metering devices 122, 124, 126, respectively. As discussed above, an automatic expansion valve, a thermal expansion valve, capillary tubing, or an orifice may be used as the metering device. Some expansion valves include backflow preventers. For purposes of illustration, but not as a limitation, the metering devices 122, 124, 126 of FIG. 2 are represented as thermal expansion valves (TEVs or TXVs). The metering devices 122, 124, 126 open and close as needed to supply high pressure refrigerant liquid to the distributors 112, 114, 116, respectively, in response to the temperature of low pressure vapor leaving the evaporators 102, 104, 106 as measured by temperature sensors 132, 134, 136, respectively.

Still referring to FIG. 2, evaporator suction line isolation valves 142, 144, and 146 in evaporator suction lines 22, 24, and 26, respectively, permit selective shutoff of flow of low pressure vapor to the low pressure vapor header 38. Evaporator high pressure liquid refrigerant line isolation valves 152, 154, 156, permit selective shutoff of supply of high pressure liquid refrigerant to distributors 112, 114, 116, respectively. When the isolation valve 86 is opened, high pressure vapor can be selectively supplied to the distributors 112, 114,116, and thence to the evaporators 102,104, 106, using valves 172, 174, and 176, respectively.

It will be understood by one skilled in the art that the use of expansion valves with built-in back flow preventers will eliminate the need for the valves 152,154, and 156 in HPL supply lines 68, 70, and 72, respectively. It will be further understood by one skilled in the art that prior art hot gas defrost methods and systems required only (1) shutting off the supply of high pressure liquid refrigerant to a group of evaporator distributors (such as 112, 114, 116) and (2) supply of high pressure vapor to the group of evaporator distributors. The process is typically either time-initiated/time-terminated or time-initiated/temperature-terminated without regard to unique characteristics of particular evaporators and the cases cooled by those evaporators.

Referring again to FIG. 2, the refrigeration system with sequential gas defrost 100 according to applicant's invention includes cross-feed lines 202, 204, and 206. Cross-feed line 202 connects the distributor 112 associated with the evaporator 102 to the evaporator suction line 22 at a location between the evaporator 102 and the isolation valve 142 in the evaporator suction line 22. Cross-feed line 204 connects the distributor 114 associated with the evaporator 104 to the evaporator suction line 24 at a location between the evaporator 104 and the isolation valve 144 in the evaporator suction line 24. Cross-feed line 206 connects the distributor 116 associated with the evaporator 106 to the evaporator suction line 26 at a location between the evaporator 106 and the isolation valve 146 in the evaporator suction line 26.

Still referring to FIG. 2, cross-feed isolation check valves 212, 214, 216 are located in the cross-feed lines 202, 204, 206, respectively, adjacent the evaporator suction lines 22, 24, 26, respectively. Orifices 222, 224, 226 are located in the cross-feed lines 202, 204, 206, respectively, adjacent the distributors 112, 114, 116, respectively. Liquid injection check valves 232, 234, 236 are located in the cross-feed lines 202, 204, 206, respectively, between the cross-feed isolation check valves 212, 214, 216 and the orifices 222, 224, 226, respectively. A line 242 tees off the cross-feed line 202 at a point between the cross-feed isolation check valve 212 and the liquid injection check valve 232. A line 244 tees off the cross-feed line 204 at a point between the cross-feed isolation check valve 214 and the liquid injection check valve 234. A line 246 tees off the cross-feed line 206 at a point between the cross-feed isolation check valve 216 and the liquid injection check valve 236. The lines 242, 244, and 246 are connected to a common cross-feed header 248.

Figure 3:
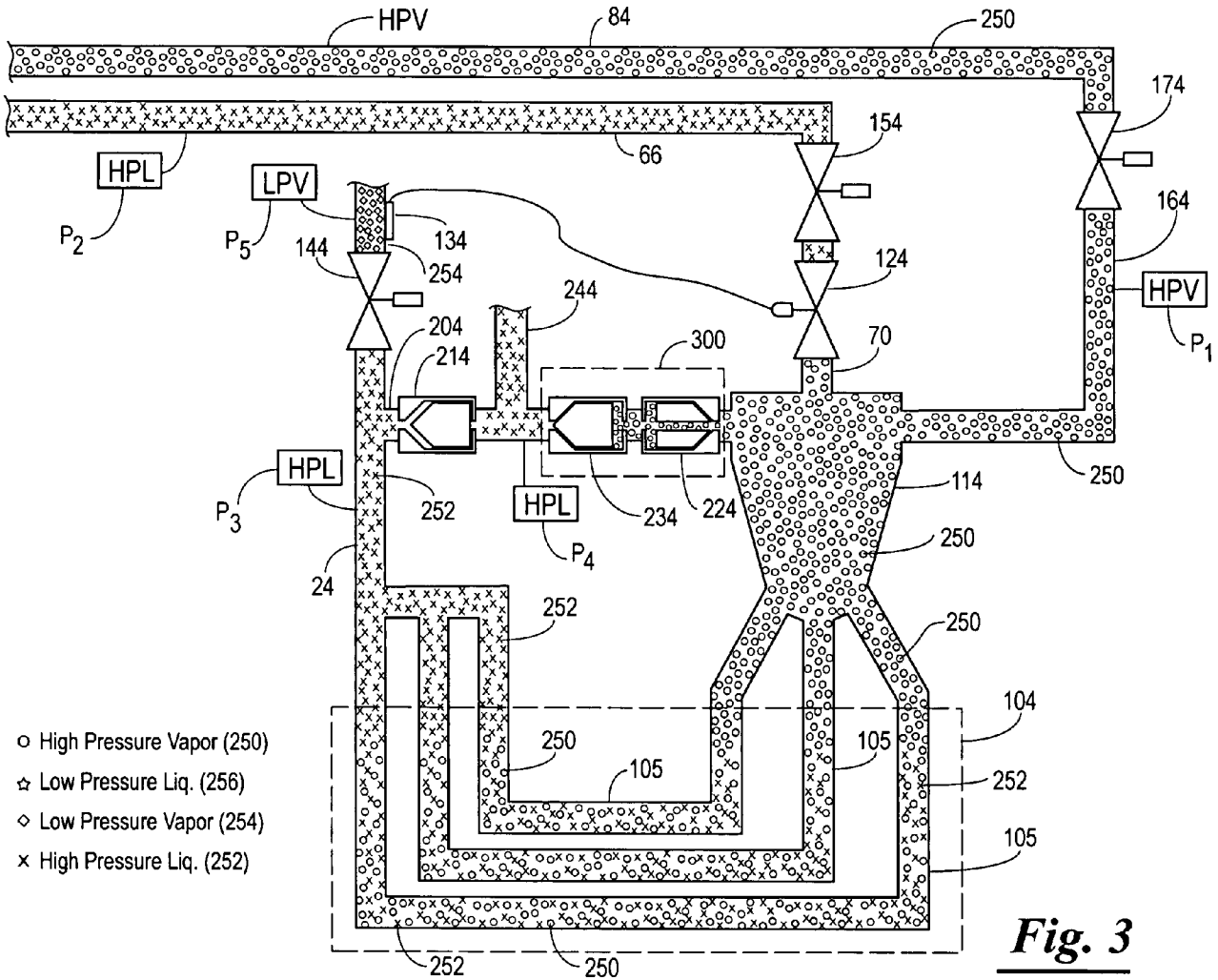
FIG. 3 is a schematic representation of an evaporator according to the present invention wherein the evaporator is being defrosted by hot refrigeration gas.

Referring now to FIG. 3, the evaporator 104 according to applicant's refrigeration system with sequential hot gas defrost 100 is shown in the defrost cycle. The defrosting evaporator 104 contains evaporator coils 105. In the defrost mode, the valve 144 in the evaporator suction line 24 and the valve 154 in the high pressure liquid supply line 70 are closed. The valve 174 in the high pressure vapor supply line is opened, thereby permitting high pressure vapor 250 (represented for purposes of illustration by circle symbols) to enter the distributor 114 and the coils 105 of the evaporator 104. As the high pressure vapor 250 gives up heat to defrost the evaporator coils 105, some of the high pressure vapor 250 condenses to become high pressure liquid 252 (represented for purposes of illustration by "x" symbols). Near the distributor 114, the coils 105 contain only high pressure vapor 250. Moving through the coils 105 toward the evaporator suction line 24, the coils 105 contain a mixture of high pressure vapor 250 and high pressure liquid 252. In the evaporator suction line 24, the coils contain only high pressure liquid 252. The condensation of the high pressure vapor 250 to high pressure liquid 252 is accompanied by release of the refrigerant's latent heat of vaporization. Thus a small amount of high pressure vapor 250 can provide a substantial amount of heating to defrost the coils 105 of the evaporator 104.

Still referring to FIG. 3, the cross-feed line 204 connects the evaporator suction line 24 and the distributor 114. The cross-feed isolation check valve 214 in the cross-feed line 204 is open because the pressure $P_3$ in the evaporator suction line 24 exceeds the pressure $P_4$ in the cross-feed line 204 where the line 244 connects the cross-feed line 204 to the common header 248 (See FIG. 2). The liquid injection check valve 234 is closed because the pressure $P_1$ associated with the high pressure vapor 250 in the distributor 114 is greater than the pressure $P_4$ of the high pressure liquid 252 in the cross-feed line 204 between the cross-feed isolation check valve 214 and the liquid injection check valve 234. The orifice 224 permits high pressure vapor 250 to move only as far as the high-pressure check valve 234. The cross-feed line 204, the cross-feed isolation check valve 214, the liquid injection check valve 234, the orifice 224, and the line 244 teeing off the cross-feed line 204 form a cross-feed assembly which is replicated for each evaporator in the evaporator group.

Figure 4:
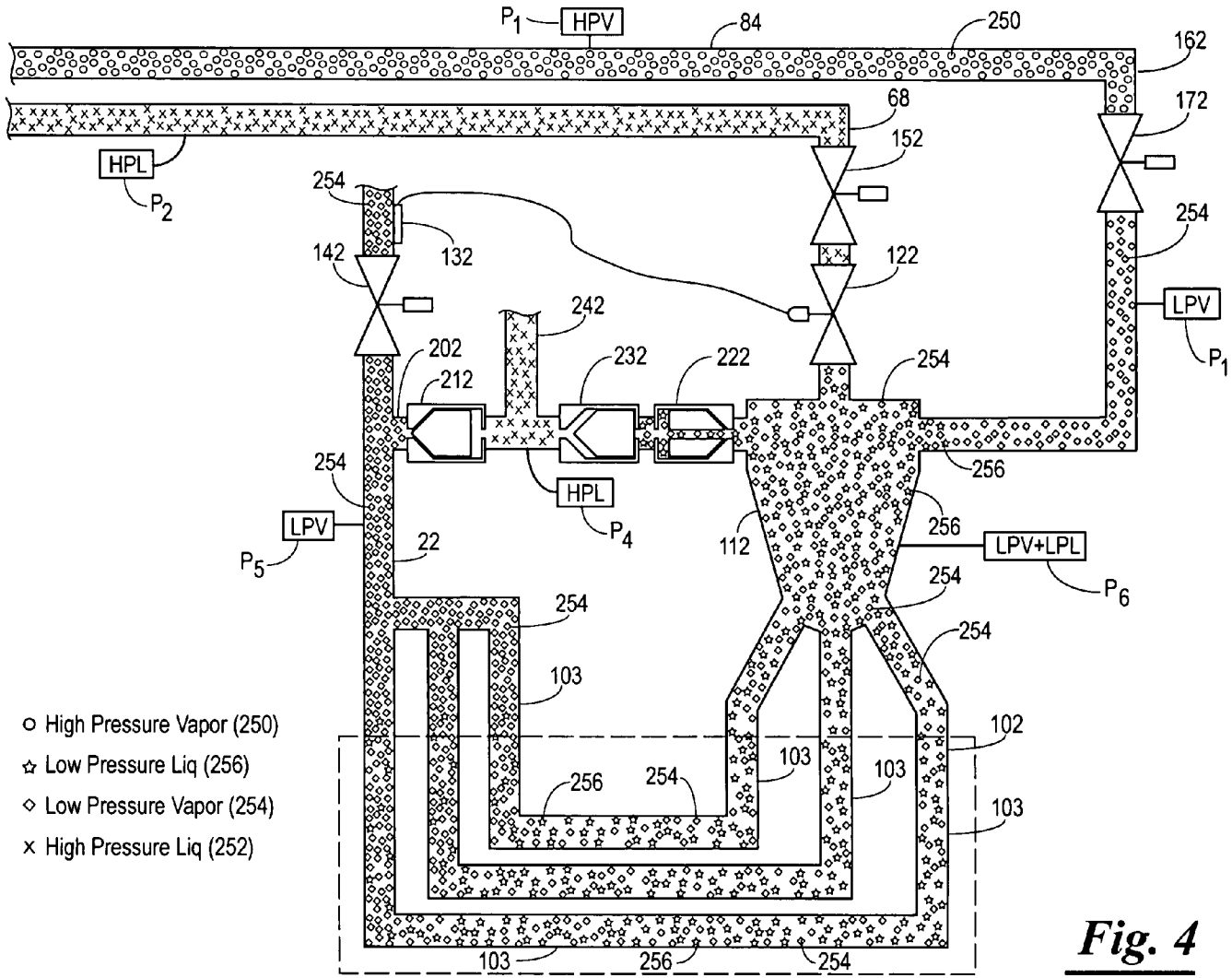
FIG. 4 is a schematic representation of an evaporator according to the present invention wherein the evaporator is cooling the circulating air within the display case.

Referring now to FIG. 4, the evaporator 102 of applicant's refrigeration system with sequential hot gas defrost 100 is shown in the refrigeration mode. The non-defrosting evaporator 102 contains evaporator coils 103. In the refrigeration mode, the valve 142 in the evaporator suction line 22 and the valve 152 in the high pressure liquid supply line 68 are open. The valve 172 in the high pressure vapor supply line 162 (also referred to as evaporator hot gas supply line) is closed, thereby prohibiting high pressure vapor 250 from entering the distributor 112 and the coils 103 of the evaporator 102. As the high pressure liquid 252 enters the evaporator coils 103, the high pressure liquid 252 first absorbs heat through the evaporator coils 103 to become a mixture of low pressure vapor 254 and low pressure liquid 256. As the mixture of low-pressure refrigerant liquid 256 and low pressure vapor 254 progresses through the evaporator coils 103 and pick up more heat, the mixture of low pressure liquid refrigerant 256 and low pressure vapor 254 becomes low pressure vapor 254. By the time the refrigerant reaches the evaporator suction line 22, the refrigerant consists completely of low pressure vapor 254. The evaporation of the high pressure liquid 252 to low pressure vapor 254 is accompanied by absorption of the refrigerant's latent heat of vaporization.

For clarity, the high pressure vapor 250 (HPG) in the drawings is indicated by symbols in the shape of a circle. Low pressure liquid 256 (LPL) in the drawings is indicated by symbols in the shape of a star. Low pressure vapor 254 (LPV) in the drawings is indicated by symbols in the shape of a diamond. High pressure liquid 252 (HPL) in the drawings is indicated by symbols in the shape of an ex ("x").

Still referring to FIG. 4, the cross-feed line 202 connects the evaporator suction line 22 and the distributor 112. The cross-feed isolation check valve 212 in the cross-feed line 202 is closed because the pressure $P_4$ in the cross-feed line 202 between the cross-feed isolation check valve 212 and the liquid injection check valve 232 exceeds the pressure $P_5$ associated with the low pressure vapor 254 in the evaporator suction line 22. Between the cross-feed isolation check valve 212 and the liquid injection check valve 232, the cross-feed line 202 contains high pressure liquid 252 from condensed high pressure vapor 250 bleeding back into the common header 248. The liquid injection check valve 232 is open because the pressure $P_4$ associated with the high pressure liquid 252 in the cross-feed line 202 is greater than the pressure $P_6$ associated with the mixture of low pressure vapor 254 and low pressure liquid 256 in the distributor 112. The orifice 222 meters a prescribed quantity of high pressure liquid 252 (based on the size of the orifice) into the distributor 112. Immediately downstream of the orifice 222 (a low pressure environment), the high pressure liquid 252 immediately becomes a mixture of low pressure vapor 254 and low pressure liquid 256. The cross-feed line 202, the cross-feed isolation check valve 212, the liquid injection check valve 232, the orifice 222, and the line 242 teeing off the cross-feed line 202 form a cross-feed line assembly identical to the cross-feed line assembly in FIG. 3.

It will be understood by one skilled in the art that the high pressure liquid 252 metered into the distributor 112 derives from another evaporator (e.g., evaporator 104, see FIG. 3 and FIG. 5) undergoing hot gas defrost. The common cross-feed header 248 provides high pressure liquid 252 to the common cross-feed header 248 whenever any evaporator in the group is in the defrost mode. Any high pressure liquid 252 in the common cross-feed header 248 is available to any evaporator operating in the refrigeration mode.

Figure 5:
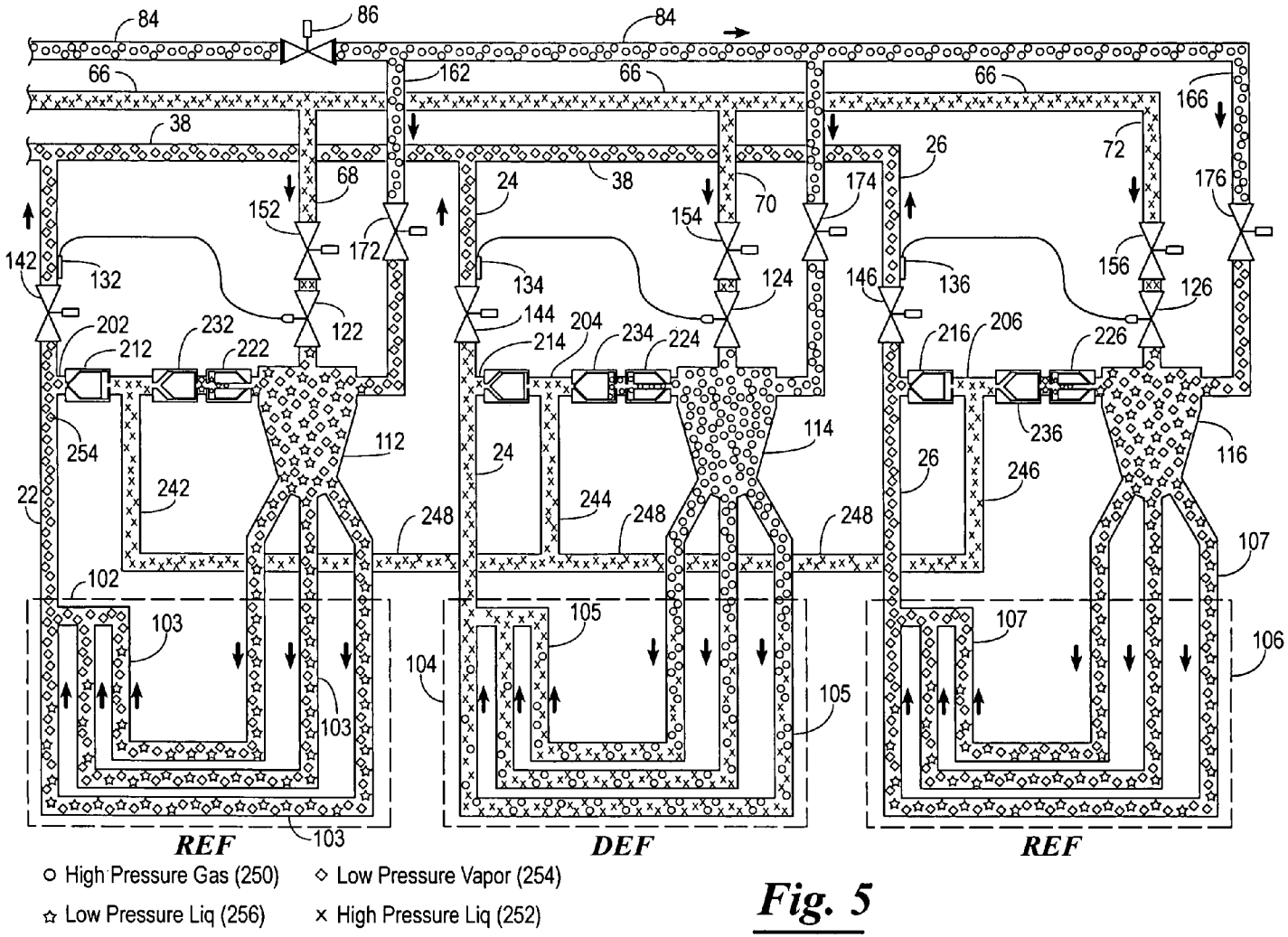
FIG. 5 is a schematic representation of the display case refrigeration system shown in FIG. 2 wherein an evaporator in one portion of the display case is being defrosted while the other two evaporators within the same display case continue to cool.

Referring now to FIG. 5, three grouped evaporators according to applicant's refrigeration system with sequential hot gas defrost 100 are shown in operation. The evaporators 102 and 106 are shown in the refrigeration mode, while the evaporator 104 is shown in the defrost cycle. The system conditions, with evaporators 102 and 106 in the refrigeration mode and evaporator 104 in the defrost mode, are as follows:

| | |
|---|---|
| High pressure vapor header valve (86) | Open |
| High pressure vapor valves 172, 176 (Refrigeration) | Closed |
| High pressure vapor valve 174 (defrost) | Open |
| Valves 142, 146 (refrigeration) | Open |
| Valve 144 (defrost) | Closed |
| Valves 152, 156 (refrigeration) | Open |
| Valve 154 (defrost) | Closed |
| Cross-feed isolation check valves 212, 216 (refrigeration) | Closed |
| Cross-feed isolation check valve 214 (defrost) | Open |
| Liquid injection check valves 232, 236 (refrigeration) | Open |
| Liquid injection check valve 234 (defrost) | Closed |
| Contents of distributors 112 & 116 (refrigeration) | Mixture of LPV and LPL |
| Contents of distributor 114 (defrost) | HPG |
| Contents of evaporator coils near distributor 112 & 116 | Mixture of LPV and LPL |
| Contents of evaporator coils near distributor 114 (Defrost) | Mixture of HPG and HPL |
| Contents of evaporator coils near exit 22 & 26 (refrigeration) | LPV |
| Contents of evaporator coils near exit 24 (Defrost) | HPL |

It will be understood by one skilled in the art that the cross-feed line 206, the cross-feed isolation check valve 216, the liquid injection check valve 236, the orifice 226, and the line 246 teeing off the cross-feed line 206 form another cross-feed line assembly identical to those shown in FIGS. 3 and 4.

Referring now to FIG. 3-4 and FIGS. 6-9, a unitary check valve/orifice 300 (CVO) provides the functions of both a check valve and also an orifice. The CVO 300 is especially suited for use in applicant's refrigeration system with sequential hot gas defrost 100. In FIG. 3, for example, wherein the evaporator 104 is shown in the defrost mode, the liquid injection check valve 234 is closed due to pressure differential as explained above and the orifice 224 is not in use. In FIG. 4, wherein the evaporator 102 is shown in the refrigeration mode, the liquid injection check valve 232 is open and the orifice 222 high pressure liquid 252 bleeds into the distributor 112 to supplement the introduction of high pressure liquid 252 into the distributor 112 through the metering device 122.

Referring now to the CVO 300 shown in FIGS. 6-9, an elongated housing 302, formed by the connection of male threaded housing member 309 to female threaded housing member 311, has line connections 304, 306 connected to a generally cylindrical outer wall 308 by tapered portions 310, 312. The elongated housing 302 encloses an elongated shuttle member 314. The shuttle member 314 has conical ends 316, 318 which conform generally to interior conical surfaces 320, 322, respectively, within the housing 302. A compression seal 324 is disposed within a groove 326 on the conical end 316 of the elongated shuttle member 314. Another compression seal 328 is disposed within a groove 330 on the other conical end 318 of the elongated shuttle member 314. A dog-leg orifice 332 includes an axial portion 334 and an angular portion 336. The axial portion 334 of the dog-leg orifice 332 extends from the center of the conical end 316 only part way toward the conical end 318. Somewhere between the middle of the elongated shuttle member 314 and the conical end 318 of the elongated shuttle member 314, the angular portion 336 of the dog-leg orifice 332 angles toward the conical end 318 of the elongated shuttle member 314. Thus one end 338 of the dog-leg orifice 332, associated with the axial portion 334, is centered on the conical end 316 of the elongated shuttle member 314. The other end 340 of the dog-leg orifice 332 is located on the conical end 318 of the elongated shuttle member 314 at a position between the groove 330 and the generally cylindrical outer wall 308 and opposite the interior conical surface 322 of the tapered portion 312 of the housing 302.

Figure 8:
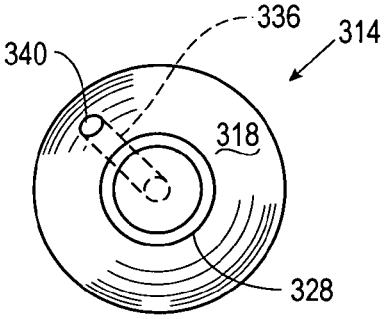
FIG. 8 is another view of the combination orifice and check valve shown in FIGS. 6-7.
Figure 9:
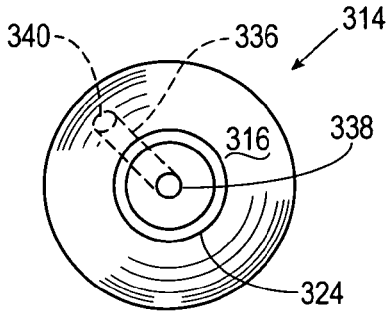
FIG. 9 is still another view of the other end of the combination orifice and check valve shown in FIGS. 6-8.

Referring now to FIGS. 8-9, channels 342 along the outside of the elongated shuttle member 314 provide passageways for fluid flow when the unitary CVO 300 is not operating as a check valve.

Figure 6:
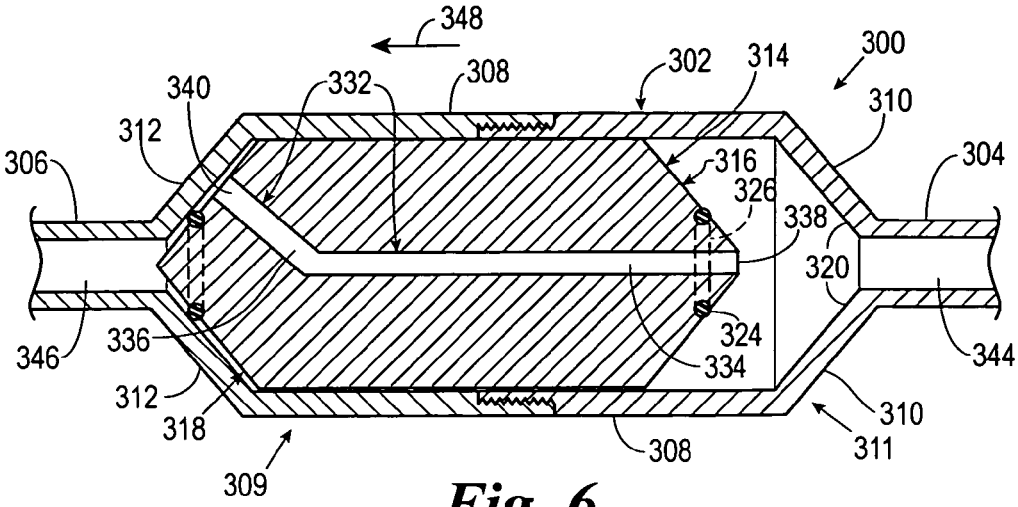
FIG. 6 is a view of an integrated orifice and check valve included in applicant's invention.

In FIG. 6, the unitary CVO 300 is illustrated in a closed position wherein no fluid flow occurs. When the fluid pressure 344 within the pipe connection 304 exceeds the fluid pressure 346 within the pipe connection 306, the elongated shuttle member 314 is forced in the direction of arrow 348 so the compression seal 328 located on the conical surface 318 of the elongated shuttle member 314 seals against the interior conical surface 322 of the tapered portion 312 of the housing 302.

Figure 7:
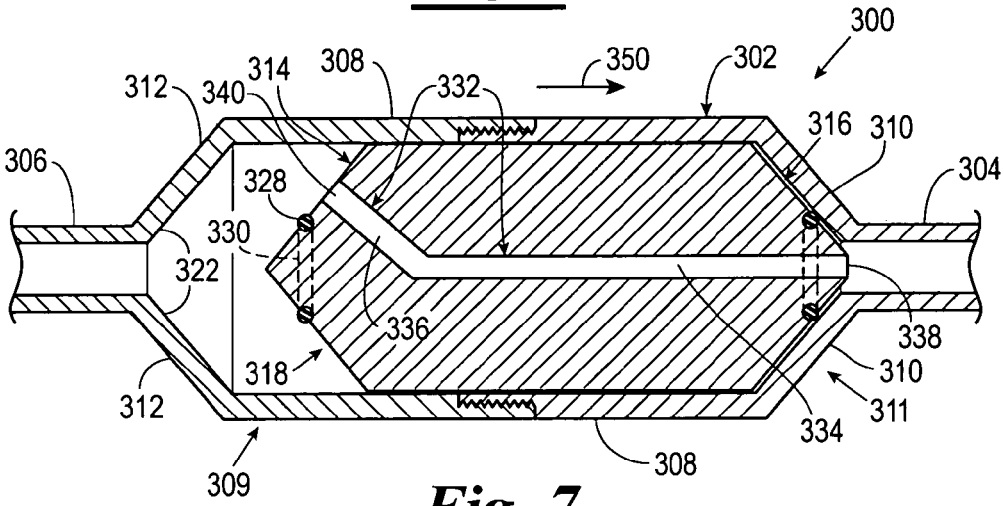
FIG. 7 is another view of the combination orifice and check valve shown in FIG. 6.

In FIG. 7, the unitary CVO 300 is illustrated in an open position wherein flow is from the pipe connection 306 end of the unitary CVO 300 to the pipe connection 304 end of the unitary CVO 300. When the fluid pressure 346 within the pipe connection 306 exceeds the fluid pressure 344 within the pipe connection 304, the elongated shuttle member 314 is forced in the direction of arrow 350 so the compression seal 328 located on the conical surface 318 of the elongated shuttle member 314 is no longer in contact with the interior conical surface 322 of the tapered portion 312 of the housing 302. Instead, the compression seal 324 located on the conical surface 316 of the elongated shuttle member 314 seals against the interior conical surface 320 of the tapered portion 310 of the housing 302. Although flow is permitted in the open position shown in FIG. 7, the flow is restricted by the sizing of the dog-leg orifice 332.

Thus applicant's unitary CVO 300 prohibits flow completely in one direction, as illustrated in FIG. 6, and, in the other direction as illustrated in FIG. 7, meters flow based on the size of the dog-leg orifice 332.

Referring once again to FIGS. 2-5, it will now be understood that applicant's unitary CVO 300 replaces the following two-part combinations of check valve and orifice: liquid injection check valve 232 and orifice 222 in evaporator 102; liquid injection check valve 234 and orifice 224 in evaporator 104; and liquid injection check valve 236 and orifice 226 in evaporator 106.

Referring now to FIGS. 10-15, another unitary CVO 400 according to applicant's invention includes an elongated housing 402, formed by the connection of male threaded housing member 409 to female threaded housing member 411, with line connections 404, 406 connected to a generally cylindrical outer wall 408 by tapered portions 410, 412. The elongated housing 402 encloses an elongated shuttle member 414. The shuttle member 414 has conical ends 416, 418 which conform generally to interior conical surfaces 420, 422, respectively, within the housing 402. A compression seal 424 is disposed within a groove 426 on the interior conical surface 420 of the housing 402. Another compression seal 428 is disposed within a groove 430 on the other interior conical surface 422 of the housing 402. A dog-leg orifice 432 in the shuttle member 414 has an axial portion 434 and an angular portion 436. The axial portion 434 of the dog-leg orifice 432 extends from the center of the conical end 416 only part way toward the conical end 418. Somewhere between the middle of the elongated shuttle member 414 and the conical end 418 of the elongated shuttle member 414, the angular portion 436 of the dog-leg orifice 432 angles toward the conical end 418 of the elongated shuttle member 414. Thus one end 438 of the dog-leg orifice 432, associated with the axial portion 434, is centered on the conical end 416 of the elongated shuttle member 414. The other end 440 of the dog-leg orifice 432 is located on the conical end 418 of the elongated shuttle member 414 at a position opposite the interior conical surface 422 between the compression seal 428 and the generally cylindrical outer wall 408 of the housing 402.

Figure 10:
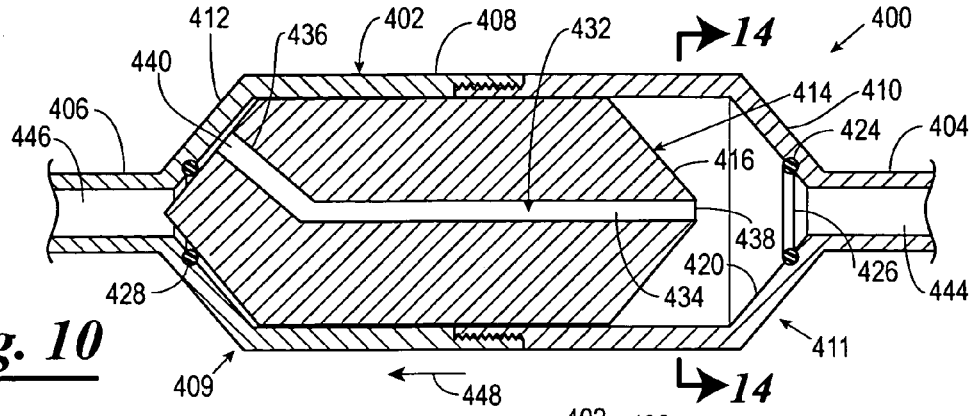
FIG. 10 is still another view of the combination orifice and check valve shown in FIGS. 6-9.

In FIG. 10, the unitary CVO 400 is illustrated in a closed position wherein no fluid flow occurs. When the fluid pressure 444 within the pipe connection 404 exceeds the fluid pressure 446 within the pipe connection 406, the elongated shuttle member 414 is forced in the direction of arrow 448 so the compression seal 428 located on the interior conical surface 422 of the elongated shuttle member 414 seals against the conical surface 418 of the elongated shuttle member 414.

Figure 11:
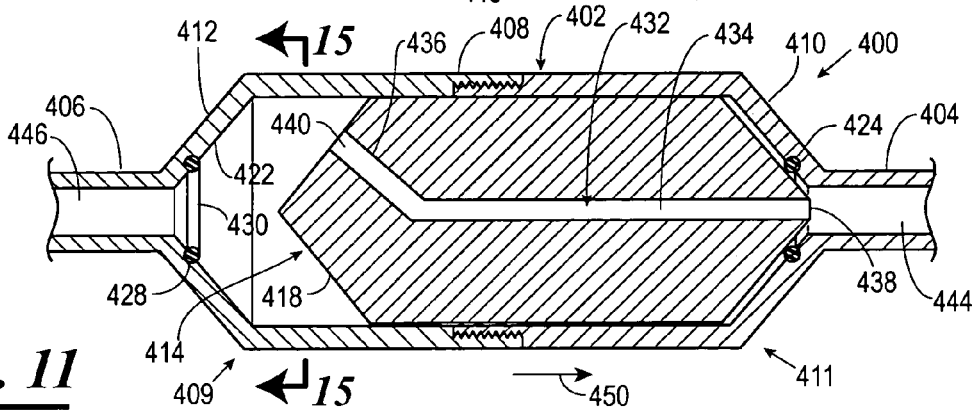
FIG. 11 is still another view of the combination orifice and check valve shown in FIGS. 6-10.

In FIG. 11, the unitary CVO 400 is illustrated in an open position wherein flow is from the pipe connection 406 end of the unitary CVO 400 to the pipe connection 404 end of the unitary CVO 400. When the fluid pressure 446 within the pipe connection 406 exceeds the fluid pressure 444 within the pipe connection 404, the elongated shuttle member 414 is forced in the direction of arrow 450 so the compression seal 428 located on the interior conical surface 422 of the housing 402 is no longer in contact with the conical surface 418 of the elongated shuttle member 414. Instead, the compression seal 424 located on the interior conical surface 420 of the housing 402 seals against the conical surface 416 of the elongated shuttle member 414. Although flow is permitted in the open position shown in FIG. 11, the flow is restricted (i.e., metered) based on the sizing of the dog-leg orifice 432.

Figure 12:
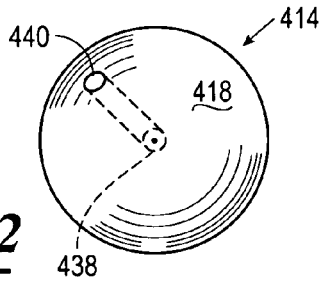
FIG. 12 is another view of the combination orifice and check valve shown in FIGS. 6-11.
Figure 13:
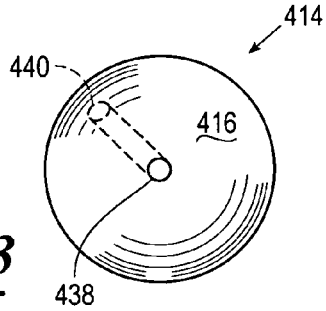
FIG. 13 is another view of the other end of the combination orifice and check valve shown in FIGS. 6-12.

Thus applicant's unitary CVO 400 prohibits flow completely in one direction, as illustrated in FIG. 11, and restricts (i.e., meters) flow in the other direction based on the size of the dog-leg orifice 432, as illustrated in FIG. 12.

Referring once again to FIGS. 2-5, it will now be understood that applicant's unitary CVO 400 can replace the following two-part combinations of check valve and orifice: liquid injection check valve 232 and orifice 222 in evaporator 102; liquid injection check valve 234 and orifice 224 in evaporator 104; and liquid injection check valve 236 and orifice 226 in evaporator 106.

Figure 14:
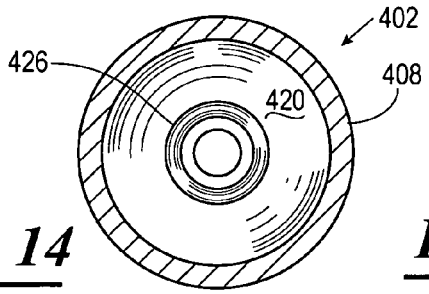
FIG. 14 is a cross-sectional view along 14-14 of the combination orifice and check valve shown in FIG. 10.

Referring now to FIG. 14, a cross-section along 14-14 in FIG. 10 shows the compression seal 426 located on the interior conical surface 420 of the housing 402.

Figure 15:
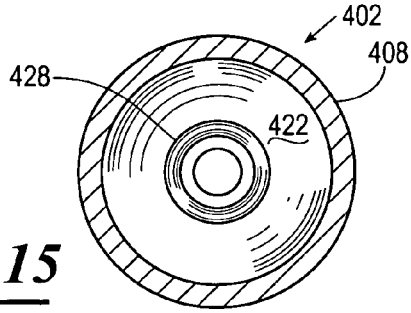
FIG. 15 is a cross-sectional view along 15-15 of the combination orifice and check valve shown in FIG. 10.

In FIG. 15, a cross-section along 15-15 in FIG. 10 shows the compression seal 428 located on the interior conical surface 422 of the housing 402.

Applicant's unitary CVO 300 and unitary CVO 400 function as a check valve in one flow direction and as an orifice in the opposite flow direction, thus simplifying installations normally requiring both a check valve and an orifice.

Referring now to FIG. 16 in conjunction with the structure shown in FIGS. 2-5, shown therein is a method of sequentially defrosting a group of evaporators using compressed hot gas as the heat source according to applicant's invention. The steps are as follows:

1. Within each evaporator in the group of evaporators, provide a cross-feed isolation check line between the evaporator suction line and the distributor, wherein each cross-feed line contains a cross-feed isolation check valve adjacent the evaporator suction line, an orifice adjacent the distributor, a liquid injection check valve between the cross-feed isolation check valve and the liquid injection check valve, and a common cross-feed header connecting each cross-feed line at a location between the cross-feed isolation check valve and the liquid injection check valve; wherein each cross-feed isolation check valve permits fluid flow from the evaporator suction line to the common cross-feed header when the pressure in the evaporator suction line exceeds the pressure in the common cross-feed header; wherein each liquid injection check valve permits fluid flow from the common cross-feed header to the distributor when the pressure in the common cross-feed header exceeds the pressure in the distributor; and wherein each orifice meters flow of high pressure liquid refrigerant from the common cross-feed header into the line to the distributor based on the sizing of the orifice.
2. With the group of evaporators in the refrigeration mode with compressors running, shut off the high pressure liquid supply to the metering device of an evaporator selected for sequential hot gas defrost from the group of evaporators.
3. Shut off the valve in the evaporator suction line from the selected evaporator.
4. Supply high pressure vapor refrigerant to the distributor associated with the evaporator selected for sequential hot gas defrost.
5. After a predetermined time, return defrosted evaporator to service in refrigeration mode as follows:
   A. Shut off the high pressure vapor refrigerant supply to the distributor associated with the defrosted evaporator.
   B. Open the valve in the evaporator suction line from the defrosted evaporator.
   C. Open the high pressure liquid supply valve to the metering device of the defrosted evaporator.
6. Repeat steps 1 through 5 for each additional evaporator in the group of evaporators until each evaporator has been defrosted.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. A method for sequentially defrosting each evaporator in a group of evaporators in a refrigeration system having a common compressor suction header and a common high pressure liquid supply header, wherein the system is characterized as having a refrigerant compressor which compresses low pressure vapor to high pressure gas in a high pressure gas header, a condenser which condenses the high pressure gas to high pressure liquid refrigerant available from a common high pressure liquid header, a high pressure gas line connecting the compressor outlet and the condenser inlet, a metering device, a high pressure liquid supply line taking high pressure liquid refrigerant from the condenser outlet to a high pressure liquid header and thence to a high pressure liquid supply valve, thence to a metering device which meters the high pressure liquid refrigerant into a distributor, evaporator coils which receive a mixture of low pressure liquid refrigerant and low pressure vapor from the distributor, an evaporator suction line taking low pressure vapor from the evaporator coils to an evaporator suction line valve and thence to the compressor suction header, a sensor located in the evaporator suction line between the evaporator coils and the evaporator suction line valve, a high pressure gas supply line taking high pressure gas from the high pressure gas header a high pressure gas line to an evaporator high pressure gas valve and, thence to the distributor, wherein the metering device meters high pressure liquid refrigerant into the distributor based on a measurement performed by the sensor, the method comprising the steps of:

Step 1. Within each evaporator in the group of evaporators, providing a cross-feed isolation check line between the evaporator suction line and the distributor, wherein each cross-feed line contains a cross-feed isolation check valve adjacent the evaporator suction line, an orifice adjacent the distributor, a liquid injection check valve between the cross-feed isolation check valve and the liquid injection check valve, and a common cross-feed header connecting each cross-feed line at a location between the cross-feed isolation check valve and the liquid injection check valve;

wherein each cross-feed isolation check valve permits fluid flow from the evaporator suction line to the common cross-feed header when the pressure in the evaporator suction line exceeds the pressure in the common cross-feed header;

wherein each liquid injection check valve permits fluid flow from the common cross-feed header to the distributor when the pressure in the common cross-feed header exceeds the pressure in the distributor; and wherein each orifice meters fluid flow from the common cross-feed header to the distributor based on the sizing of the orifice;

Step 2. Within the group of evaporators in the refrigeration mode with the compressors running, selecting an evaporator to be defrosted;

Step 3. Shutting off the high pressure liquid supply valve between the high pressure liquid header and the metering device; associated with the selected evaporator Step 4. Shutting off the valve in the evaporator suction line associated with the selected evaporator;

Step 5. Supplying hot gas refrigerant to the distributor associated with the selected evaporator;

Step 6. After the selected evaporator is defrosted, returning the defrosted evaporator to service in refrigeration mode as follows:

A. Shutting off the high pressure gas refrigerant supply to the distributor associated with the now-defrosted selected evaporator;

B. Opening the valve in the evaporator suction line associated with the now-defrosted selected evaporator; and C. Opening the high pressure liquid supply valve to the metering device associated with the now-defrosted selected evaporator;

Step 7. Repeating steps 1 through 5 for each additional evaporator in the group of evaporators until each evaporator has been defrosted.

2. The method of claim 1 wherein the liquid injection check valve and the orifice provided in step 1 are contained in a unitary combination check valve and orifice.

3. The method of claim 2, wherein the unitary combination check valve and orifice further comprises:

an elongated housing having a generally cylindrical outer wall with housing tapered ends, interior conical surfaces conforming to the tapered ends, and a line connection on each end;

an elongated shuttle member disposed within the elongated housing, the elongated shuttle member having shuttle member conical ends conforming generally to the interior conical surfaces of the elongated housing;

a compression seal disposed within a groove on one conical end of the elongated shuttle member;

a second compression seal is disposed within a second groove on the other conical end of the elongated shuttle member;

a dog-leg orifice having an axial portion and an angular portion, wherein the axial portion of the dog-leg orifice extends from the center of the shuttle member conical end only part way toward the other conical end of the elongated shuttle member, and wherein the angular portion of the dog-leg orifice angles toward the other conical end of the elongated shuttle member, so one end of the dog-leg orifice associated with the axial portion is centered on one conical end of the elongated shuttle member and the other end of the dog-leg orifice is located on the other conical end of the elongated shuttle member at a position between the groove on the other conical end and the generally cylindrical outer wall opposite the interior conical surface of the tapered portion of the other end of the elongated housing; and wherein the elongated housing further comprises a male threaded housing member connected to a female threaded housing member so the housing members can be disconnected for access to the elongated shuttle member and connected for use as a combination check valve and orifice.

4. A sequential hot gas defrost refrigeration system for use in conjunction with a group of evaporators having a common high pressure liquid refrigerant supply header and a common evaporator suction header, wherein each evaporator cycles between a refrigeration mode wherein the evaporator cools the contents of a refrigerated display case and a defrost mode wherein the evaporator is heated to removed accumulated frost, the sequential hot gas defrost refrigeration system comprising:

a compressor for compressing low pressure vapor refrigerant to high pressure vapor refrigerant;

a high pressure vapor refrigerant line connecting the compressor to a condenser for condensing the high pressure vapor refrigerant to high pressure liquid refrigerant;

a high pressure liquid line connecting the condenser to a receiver for collecting the condensed high pressure liquid refrigerant and thence to a high pressure liquid refrigerant supply header;

a hot gas main supply line connected at one end to the high pressure vapor refrigerant line at the discharge of the compressor and at the other end to a hot gas main supply line isolation valve, thence to a hot gas header;

wherein, for each evaporator in the group of evaporators:

an evaporator high pressure liquid refrigerant line connects the high pressure liquid refrigerant supply header to an evaporator high pressure liquid refrigerant line isolation valve, thence to a metering device in the high pressure liquid refrigerant line and thence to a distributor;

an evaporator suction line connects the evaporator to an evaporator suction line isolation valve and thence to the common evaporator suction header;

a temperature sensor is located in the evaporator suction line between the evaporator suction line isolation valve and the common evaporator suction header;

an evaporator hot gas supply line connects the hot gas header to an evaporator hot gas supply line isolation valve and thence to the evaporator distributor;

a cross-feed line assembly connects the evaporator distributor to the evaporator suction line at a location in the evaporator suction line between the evaporator and the evaporator suction line isolation valve the cross-feed line assembly further comprising a cross-feed line connecting the evaporator suction line to a cross-feed isolation check valve, thence to a line teeing off the cross-feed line, thence to a liquid injection check valve, thence to an orifice, and thence to the evaporator distributor; and a common cross-feed header connecting the lines teeing off the cross-feed lines from each evaporator within the group of evaporators;

wherein, during the refrigeration mode, the hot gas main supply line isolation valve is closed, the evaporator hot gas supply line isolation valves are closed, the evaporator high pressure liquid refrigerant line isolation valves are open, the evaporator suction line isolation valves are open, the metering devices meter high pressure liquid refrigerant into the distributors based on the temperatures measured by the temperature sensors located in the evaporator suction lines between the evaporator suction line isolation valves and the common evaporator suction headers; and wherein, during defrost of one of the evaporators selected from the group of evaporators, the hot gas main supply line isolation valve is opened, the defrosting evaporator hot gas supply line isolation valve is opened, the defrosting evaporator high pressure liquid refrigerant line isolation valve is opened, and the defrosting evaporator suction line isolation valve is closed, so that no high pressure liquid refrigerant is metered into the defrosting evaporator distributor by the defrosting evaporator metering device;

wherein, during defrost of the defrosting evaporator, the isolation check valve in the defrosting evaporator cross-feed line is open, the liquid injection check valve in the defrosting evaporator cross-feed line is closed, high pressure liquid refrigerant produced as a result of condensation of the hot gas refrigerant introduced into the defrosting evaporator distributor bleeds into the line teeing off the defrosting evaporator cross-feed line, through the common cross-feed header connecting the lines teeing off the cross-feed lines, and into the cross-feed lines of the non-defrosting evaporators within the group of evaporators, so the high pressure liquid refrigerant in the cross-feed lines of the non-defrosting evaporators is metered into the distributors of the non-defrosting evaporators by the orifices in the cross-feed lines of the non-defrosting evaporators;

so that high pressure liquid refrigerant produced in the defrosting evaporator is available for refrigeration of the non-defrosting evaporators.

5. A combination check valve and orifice, comprising:

an elongated housing having a generally cylindrical outer wall with housing tapered ends, interior conical surfaces conforming to the tapered ends, and a line connection on each end;

an elongated shuttle member disposed within the elongated housing, the elongated shuttle member having shuttle member conical ends conforming generally to the interior conical surfaces of the elongated housing;

a compression seal disposed within a groove on one conical end of the elongated shuttle member;

a second compression seal is disposed within a second groove on the other conical end of the elongated shuttle member;

a dog-leg orifice having an axial portion and an angular portion, wherein the axial portion of the dog-leg orifice extends from the center of the shuttle member conical end only part way toward the other conical end of the elongated shuttle member, and wherein the angular portion of the dog-leg orifice angles toward the other conical end of the elongated shuttle member, so one end of the dog-leg orifice associated with the axial portion is centered on one conical end of the elongated shuttle member and the other end of the dog-leg orifice is located on the other conical end of the elongated shuttle member at a position between the groove on the other conical end and the generally cylindrical outer wall opposite the interior conical surface of the tapered portion of the other end of the elongated housing; and wherein the elongated housing further comprises a male threaded housing member connected to a female threaded housing member so the housing members can be disconnected for access to the elongated shuttle member and connected for use as a combination check valve and orifice.

* * * * *